US007430890B1

(12) United States Patent
Battaglia

(10) Patent No.: US 7,430,890 B1
(45) Date of Patent: Oct. 7, 2008

(54) TELESCOPING TOWER AND METHOD OF MANUFACTURE

(76) Inventor: Vincent P Battaglia, 209 Banks Rd., Easton, CT (US) 06612

( * ) Notice: Subject to any disclaimer, the term of this patent is extended or adjusted under 35 U.S.C. 154(b) by 527 days.

(21) Appl. No.: 11/166,888

(22) Filed: Jun. 24, 2005

(51) Int. Cl.
*B21D 5/02* (2006.01)

(52) U.S. Cl. ..... 72/368; 72/389.3; 72/414

(58) Field of Classification Search ..... 72/101, 72/105, 319, 389.1, 389.3, 368, 414
See application file for complete search history.

(56) References Cited

U.S. PATENT DOCUMENTS 2,115,441 A * 4/1938 Biack ..... 72/368
3,218,839 A * 11/1965 Rosanes ..... 72/412
4,932,176 A 6/1990 Roberts et al.
5,058,269 A * 10/1991 May ..... 29/897.35
5,775,162 A * 7/1998 Ward ..... 72/389.3
5,786,854 A 7/1998 Slade et al.
6,601,427 B2 * 8/2003 Kondou et al. ..... 72/368
6,751,993 B2 * 6/2004 Sekita et al. ..... 72/31.1

* cited by examiner

*Primary Examiner*—David B Jones
(74) *Attorney, Agent, or Firm*—DeLio & Peterson, LLC; Peter W. Peterson

(57) ABSTRACT

A mast section for a telescoping tower system is made by aligning press brake tools along the length of the metal sheet at spaced width locations and forming the corners of the tube. After forming of the last corner, an opening remains along the length of the tube. The press brake male tool axis is offset sufficiently to permit the tool to apply forming force to the last corner of the tube through the opening, and is sized to remove the tool from the opening. At least three mast sections are nested to form the tower system. Pulleys for a cable extension system are mounted near the upper and lower ends of a wall of an intermediate mast section, with one of the pulleys being oriented at an acute angle to the mast section wall to permit routing of the cable.

7 Claims, 11 Drawing Sheets

TELESCOPING TOWER AND METHOD OF MANUFACTURE

BACKGROUND OF THE INVENTION

1. Field of the Invention

The present invention relates to a telescoping tower and method of manufacturing same and, in particular, to a portable telescoping tower system whose mast sections may be manufactured from flat sheet stock.

2. Description of Related Art

Telescoping tower systems are known from the prior art, for example, U.S. Pat. No. 5,786,854. While these tower systems have demonstrated that it is possible to construct a portable, simultaneous expansion system, in practice they have been thought to require extruded square tube sections because of the relatively high degree of dimensional tolerance required for the sections to nest closely together when in the retracted position and extend in a smooth and straight manner. Since extrusion is a costly process, a more economical mast section construction method is needed, which maintains or improves on straightness and dimensional tolerance. Moreover, the particular method of orienting the pulleys in the tower system built from the '854 patent has also caused problems in efficient construction and operation, in both the cable system used to extend the mast sections, and in the cable system used to synchronize relative movement between adjacent mast sections.

SUMMARY OF THE INVENTION

Bearing in mind the problems and deficiencies of the prior art, it is therefore an object of the present invention to provide a method of manufacturing the mast sections in a telescoping tower that provides high dimensional accuracy at lower manufacturing costs.

It is another object of the present invention to provide an improved pulley system in a telescoping tower that simplifies cable guiding between mast sections.

A further object of the invention is to provide a pulley system in a telescoping tower that permits close nesting of mast sections for both a powered cable used to raise the tower, and synchronizing cables used to synchronize relative movement between the mast sections.

Still other objects and advantages of the invention will in part be obvious and will in part be apparent from the specification.

The above and other objects, which will be apparent to those skilled in the art, are achieved in the present invention which is directed to a method of manufacturing a tube having a polygonal cross-section with at least one side wall opening therein comprising providing a sheet of metal having a length and a width and providing male and female press brake tools for forming corners in the tube. The press brake tools have a width conforming to the length of the metal sheet, and the male press brake tool has an offset axis along which forming force may be applied to the metal sheet to form the tube corners. The method includes forming at least one opening in the metal sheet conforming to the at least one tube side wall opening and, after forming the at least one opening in the metal sheet, aligning the press brake tools along the length of the metal sheet at a first width location and forming a first corner of the tube. The method then includes aligning the press brake tools along the length of the metal sheet at a second width location and forming a second corner of the tube, aligning the press brake tools along the length of the metal sheet at a third width location and forming a third corner of the tube, and aligning the press brake tools along the length of the metal sheet at a fourth width location and forming a fourth corner of the tube. The width locations closest to edges along the width of the metal sheet are less than the dimension of the tube between the corners formed at such width locations such that, after forming of the last corner, an opening remains along the length of the tube between the corners formed at such width locations. The press brake male tool axis is offset sufficiently to permit the tool to apply forming force to the last corner of the tube through the opening remaining along the length of the tube.

The press brake male tool is preferably sized sufficiently to permit the tool to be removed through the opening remaining along the length of the tube after applying forming force to the last corner of the tube. The width locations closest to edges along the width of the metal sheet are preferably located at a distance from the closest edge which is less than one half the dimension of the tube between the corners formed at such width locations.

The at least one opening in the metal sheet may be formed by mechanical punching or by laser cutting.

Preferably, the tube has a rectangular cross-section. Regardless of the cross-section, the method preferably further includes closing the opening along the length of the tube with a second metal sheet.

In another aspect, the present invention is directed to a telescoping tower system comprising at least three mast sections each having upper and lower ends and walls separated by corners between the ends. The mast sections have different cross sectional sizes to permit the sections to nest, with the largest mast section forming the lowermost base section and the smallest mast section forming the uppermost top section. The tower system also includes pulleys mounted near the upper and lower ends of a wall of an intermediate mast section, one of the pulleys being oriented at an acute angle with respect to the mast section wall to permit a cable to be routed from inside the mast section to outside the mast section. The tower system also includes a cable drum and a cable extending between adjacent nested mast sections from the uppermost mast section through the pulleys on the intermediate mast section to the cable drum. The cable is adapted to raise and extend the mast sections upon rotation of the cable drum in one direction.

Preferably, the other pulley on the intermediate mast section is oriented parallel to the mast section wall.

The tower system preferably includes at least four mast sections, and at least two intermediate mast sections, and wherein each intermediate mast section has a pulley oriented at an acute angle with respect to the mast section wall near one end and a pulley oriented parallel to the mast section wall near the other end. The intermediate mast sections may have a pulley oriented at an acute angle with respect to the mast section wall near the same relative ends, or near opposite relative ends.

The tower system preferably further includes a second cable between the uppermost mast section and the cable drum. The second cable is adapted to lower and retract the mast sections upon rotation of the cable drum in the opposite direction.

In a further aspect, the present invention is directed to a telescoping tower system comprising at least three mast sections each having upper and lower ends and walls separated by corners between the ends. The mast sections have different cross sectional sizes to permit the sections to nest, with the largest mast section forming the lowermost base section and the smallest mast section forming the uppermost top section. The tower system also includes synchronizing pulleys mounted near the upper and lower ends of a wall of the intermediate mast section. Each of the synchronizing pulleys is oriented at an acute angle with respect to the mast section wall to permit a synchronizing cable to be routed from inside the mast section to outside the mast section. The tower system also includes a pair of synchronizing cables extending between adjacent nested mast sections from the uppermost mast section through the synchronizing pulleys on the intermediate mast section to the lowermost mast section. The synchronizing cables are adapted to synchronize movement of the mast sections upon raising and lowering of the uppermost mast section with respect to the lowermost mast section.

The tower system may further include at least one additional nesting mast section, with each additional nesting mast section having synchronizing pulleys mounted near the upper and lower ends of a wall of the mast section. Each of the synchronizing pulleys is oriented at an acute angle with respect to the mast section wall to permit a synchronizing cable to be routed from inside the mast section to outside the mast section. Each group of three adjacent mast sections includes a pair of synchronizing cables extending between adjacent nested mast sections from the uppermost mast section of the group through the synchronizing pulleys on the intermediate mast section of the group to the lowermost mast section of the group. The synchronizing cables are adapted to synchronize movement of the mast sections of the group upon raising and lowering of the uppermost mast section of the group with respect to the lowermost mast section of the group. The synchronizing pulleys used to synchronize movement for each group of three adjacent mast sections are preferably located on walls on different relative sides of the mast sections. If the synchronizing pulleys are used with pulleys used by a powered cable for raising and extending the mast sections, the synchronizing pulleys are located on walls on different relative sides of the mast sections than the pulleys used by the powered cable.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-11 of the drawings in which like numerals refer to like features of the invention.

Figure 1:
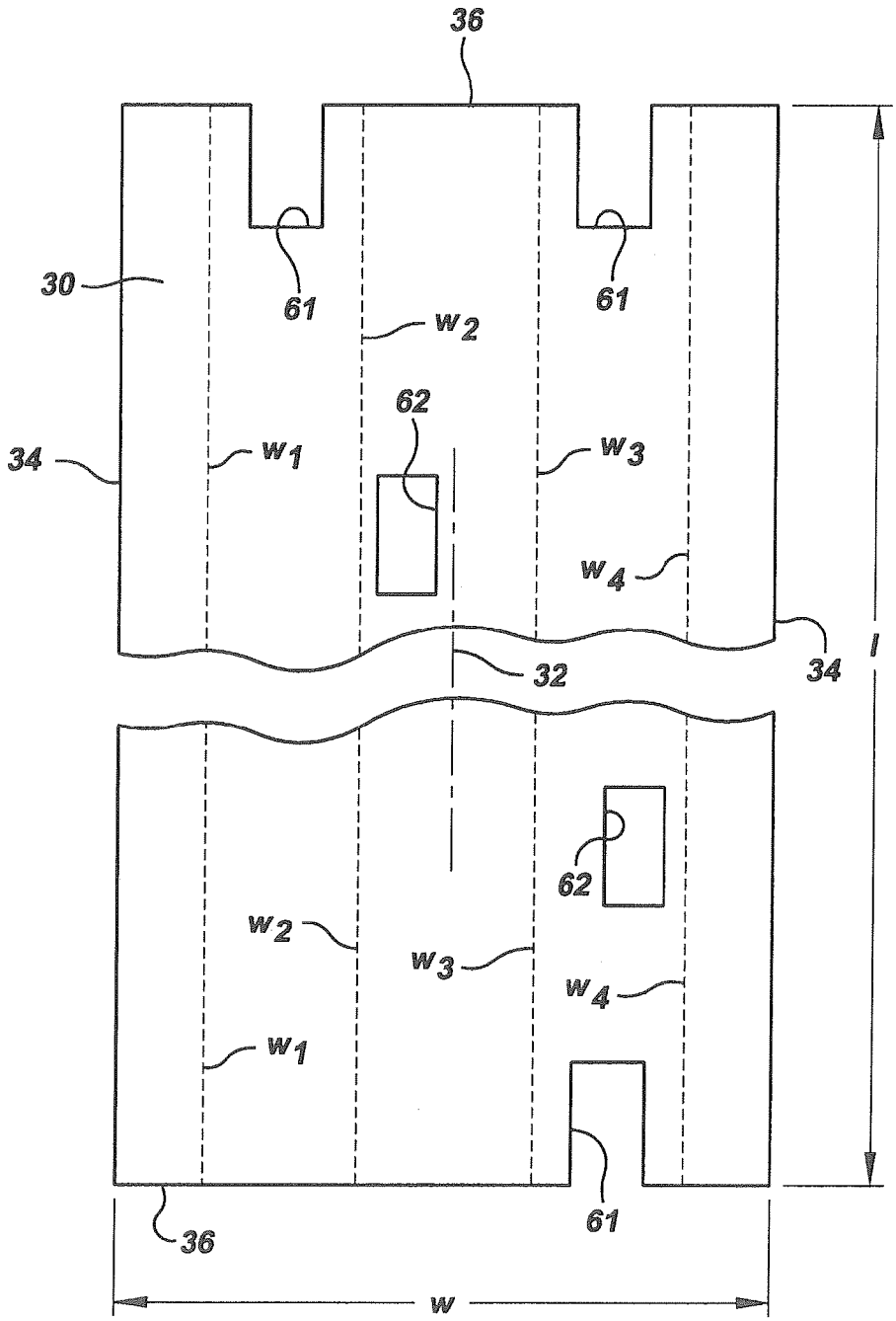
FIG. 1 is a top plan view of a metal sheet cut and marked in preparation of forming a mast section for the telescoping tower system of the present invention.

Instead of utilizing high cost manufacturing methods for the mast sections of a telescoping tower system, such as extrusion, the present invention utilizes formed sheets to manufacture the tubular masts. As shown in FIG. 1, flat sheet stock 30 has a width (w) and a length (l) between ends 36, the length (l) dimension corresponding to the length of the mast section. Located at desired parallel locations across width w are width locations $w_1$, $w_2$, $w_3$, and $w_4$, which identify the locations of the sheet at which the four corners are to be formed. While this invention preferably uses a rectangular tubular mast section, more preferably a square tubular mast section, sections having other polygonal cross-sections with varying numbers of sides may be made using the method of the present invention.

Figure 2:
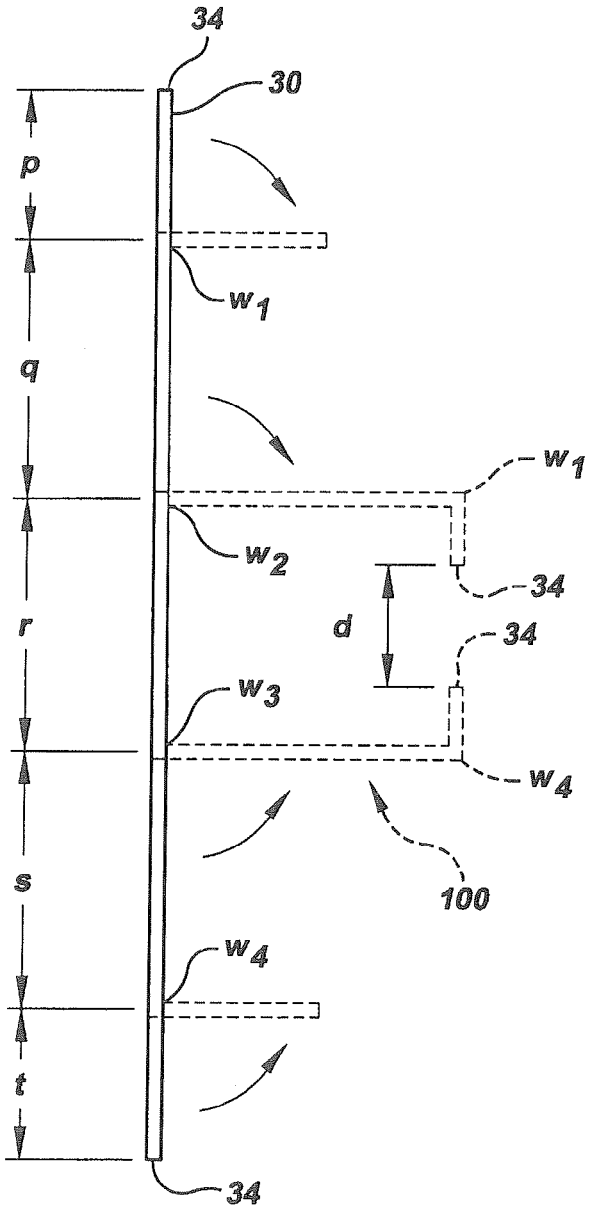
FIG. 2 is an end elevational view showing the progression of a corner formation in the metal sheet of FIG. 1 to make a mast section.

Since the finished mast section will require openings of various configurations at different positions, preferably such openings are formed in the sheet 30 while it is still flat, prior to formation of the mast section corners. Such openings are shown as end opening 61 and intermediate openings 62 within the field of the sheet 30. Such openings may be cut or formed by any known technique, such as by mechanical punching or by laser cutting, or a combination of the two. FIG. 2 shows the formation in phantom lines of the corners and side walls of the mast section 100 as sheet 30 is bent at width locations $w_1$, $w_2$, $w_3$, and $w_4$. While the individual segment widths p, q, r, s and t may be any desired dimension, it is important that the finished mast section leave an opening, shown as dimension d, between opposite sheet edges 34. Thus in the square tube section preferred in the present invention, the dimensions are such that:

$$q=r=s=(p+t+d), \text{ and } p=t<\tfrac{1}{2}(q \text{ or } r \text{ or } s)$$

Figure 3:
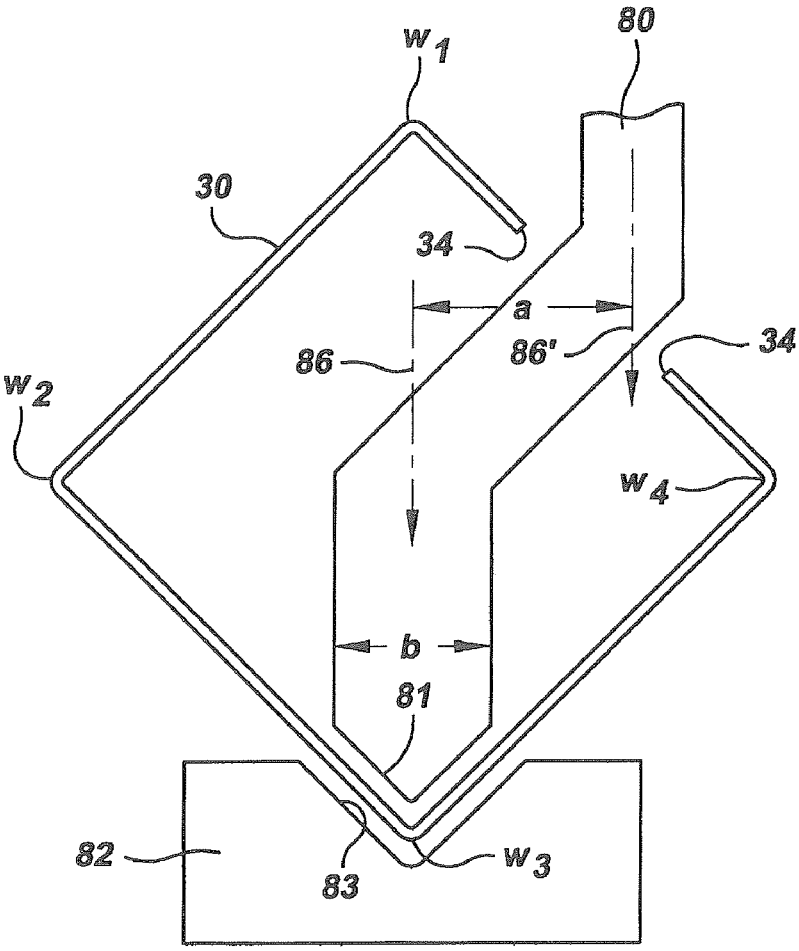
FIG. 3 is an end elevational view showing the press brake tooling forming the corners to manufacture the mast section shown in FIG. 2.

The dimension of opening d in the finished tubular mast section should be sufficient to enable the use and removal of a press brake forming tool. The preferred press brake tool system is shown in FIG. 3, wherein a female tool 82 has a V-shaped surface 83 with the legs of the V at a 90° angle with respect to each other. Likewise, male press tool 80 has a male V-shaped surface 81 with legs also at a 90° angle. If the polygonal mast section is to have more than four sides and other than square corners, additional corners are formed and the male and female press brake forming surfaces should match the appropriate angle for each corner.

While the corners may be formed at width locations $w_1$ through $w_4$ in any order, preferably the corner locations closest to the opposite side edges 34 are formed first, i.e., $w_1$ and $w_4$ (in any order), followed by formation of the corner segments at the inner corner locations $w_2$ and $w_3$ (also in any order).

In order to form the mast section by the method of the present invention, by the time the last corner segment is formed in sheet 30, here shown as the corner at width location $w_3$, male tool portion 80 is preferably configured so that the greatest tool thickness b is less than the opening dimension d between opposite ends 34 so that the tool may be removed through the opening. Alternatively, after bending the corners, the formed mast section may be slid out from the end of the tool, in a direction perpendicular to the page of FIG. 3. Male tool portion 80 preferably has an offset axis so that a force can be applied in a direction 86 which bisects the angles formed by the complementary V-shaped tool surfaces 81, 83. As shown in FIG. 3, application of force in the desired direction 86 is accomplished by applying force along offset axis 86' at the upper end of male tool 80, which force is transferred by the diagonal tool portion to the base 81 and applied to the metal strip at corner location $w_3$ in direction 86. The degree of this offset axis, shown as dimension a between the parallel force lines 86, 86', may be determined without undue experimentation according to the requirements of the size and material used for the particular mast section being formed.

The length of the male and female tool members 80, 82 (the dimension perpendicular to the plane of the page of FIG. 3) should be comparable to the length l of sheet 30, so that each corner is smoothly formed along its entire length simultaneously.

Figure 4:
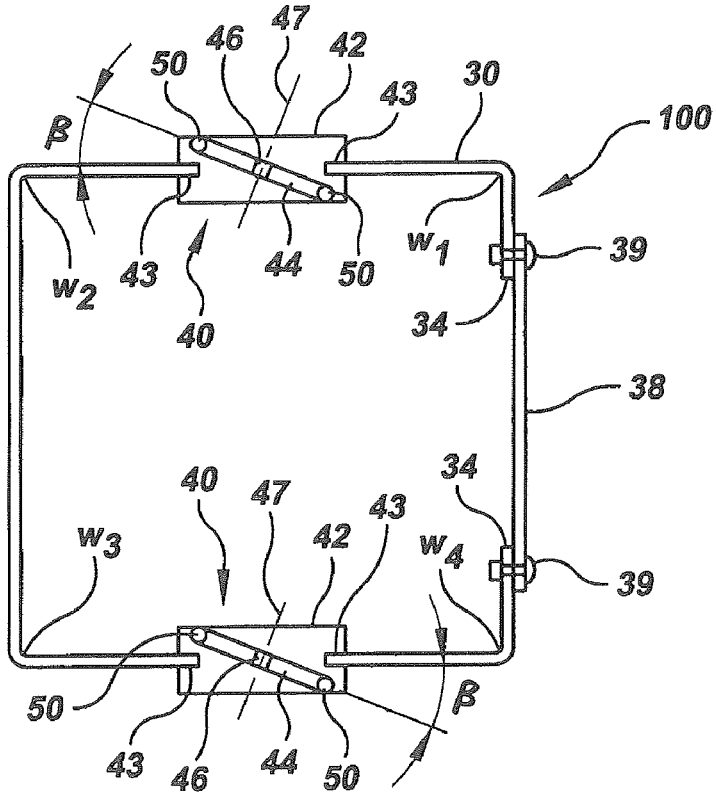
FIG. 4 is a top plan view of the finished mast section, including angled pulleys of the present invention.

To complete the structure of the mast section 100 formed from sheet 30, as shown in FIG. 4, a flat strip segment 38 is secured over the opening between opposite sheet 30 ends 34. While this may be done by any means such as by welding, the use of fasteners 39 is shown in this embodiment. This strip 38 preferably runs the entire length of the mast section. Each wall of each mast section is preferably flat, or essentially planar.

The mast sections of the telescoping tower are formed in hollow, cross-sectional sizes that nest closely within one another, in the number and length to reach the desired height when they are fully extended from one another. While the preferred embodiment depicted herein has eight mast sections, any number of sections may be used, preferably at least three. To achieve such close nesting and extension, the present invention utilizes pulleys that form acute, preferably very shallow, angles with the mast section walls to carry the cables that extend and retract the mast sections. The cables used for the present invention are preferably steel cables, but other types and compositions of lines and ropes are included within the understanding of the term cable as used herein.

Figure 5:
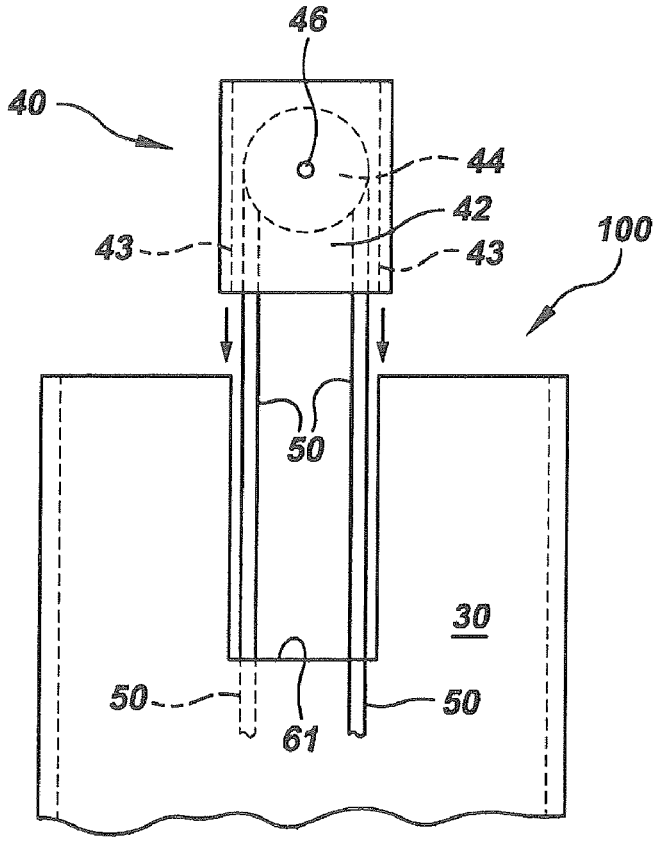
FIG. 5 is a side elevational view of the preferred angled pulley cartridge to be mounted in a mast section of the present invention.

FIGS. 4 and 5 show the preferred pulley cartridges 40 as used in the mast sections of the present invention. Pulley cartridges 40 have housing 42 which supports a central bearing 46 on which angled pulley 44 rotates about axis 47. Housing 42 includes side slots 43 that receive the edges of openings 61 in mast section 100 to permit the cartridge to slide into and be secured near the ends of the mast section. As shown in FIG. 4, the plane of angled pulley 44 is oriented at an acute angle $\beta$ with respect to the wall of tube or mast section 100. Angle $\theta$ preferably forms a shallow angle of less than about 45°, more preferably of about 18°, with the mast section wall, and the pulley axis 47 is preferably at an angle larger than about 45° and less than 90°, more preferably about 72°, with respect to the mast section wall. The acute angle of the pulley permits the pulley cartridge to receive cable 50 from the inside of mast section 100, and transfer it to the outside of the mast section, or vice versa, using a minimum of space. Since these mast sections are nested to create the telescoping tower of the present invention, such space conservation is important in creating a compact tower system.

Figure 6:
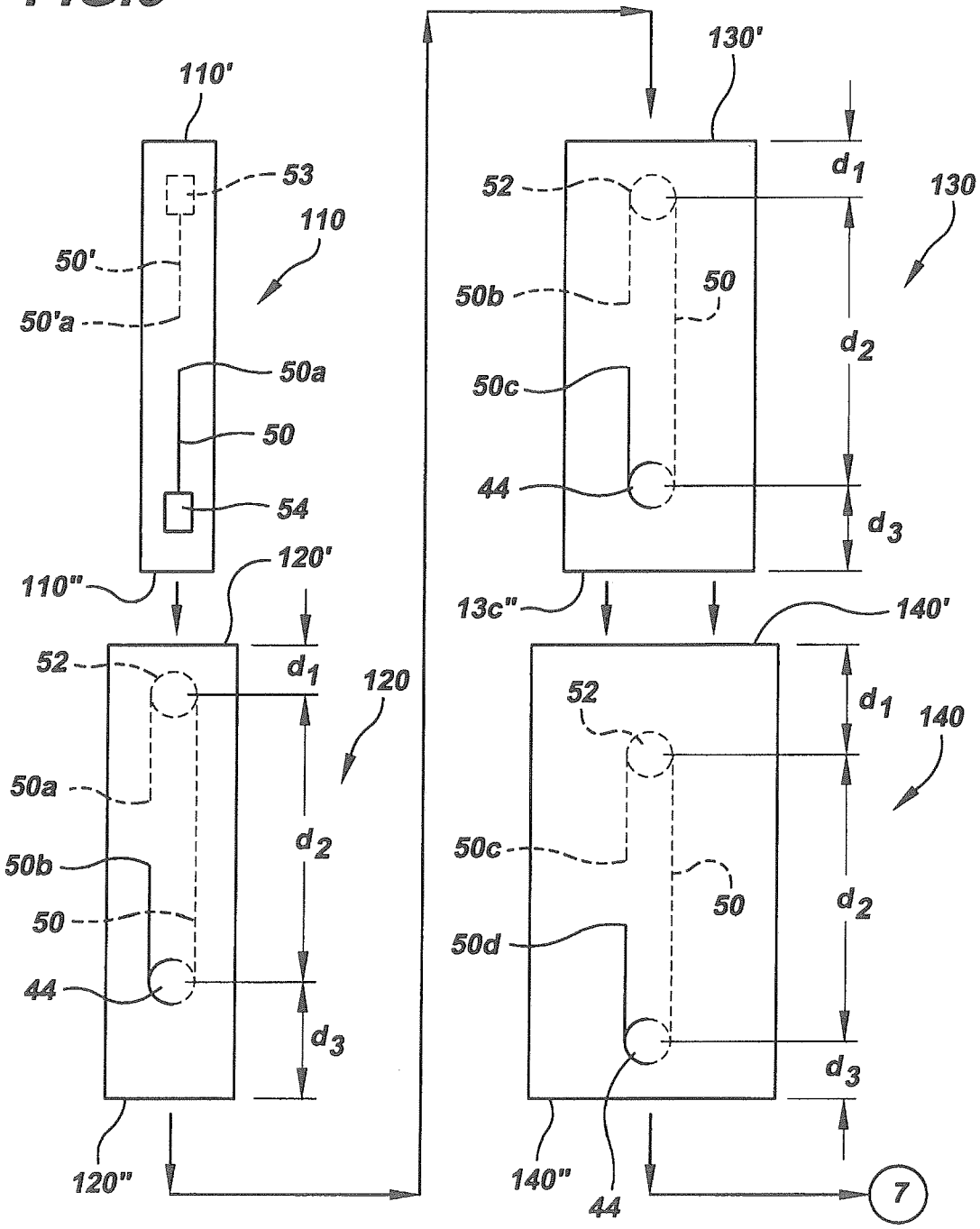
FIG. 6 is a side elevational exploded view of the inner four nested mast sections used to make the preferred telescoping tower system of the present invention.
Figure 7:
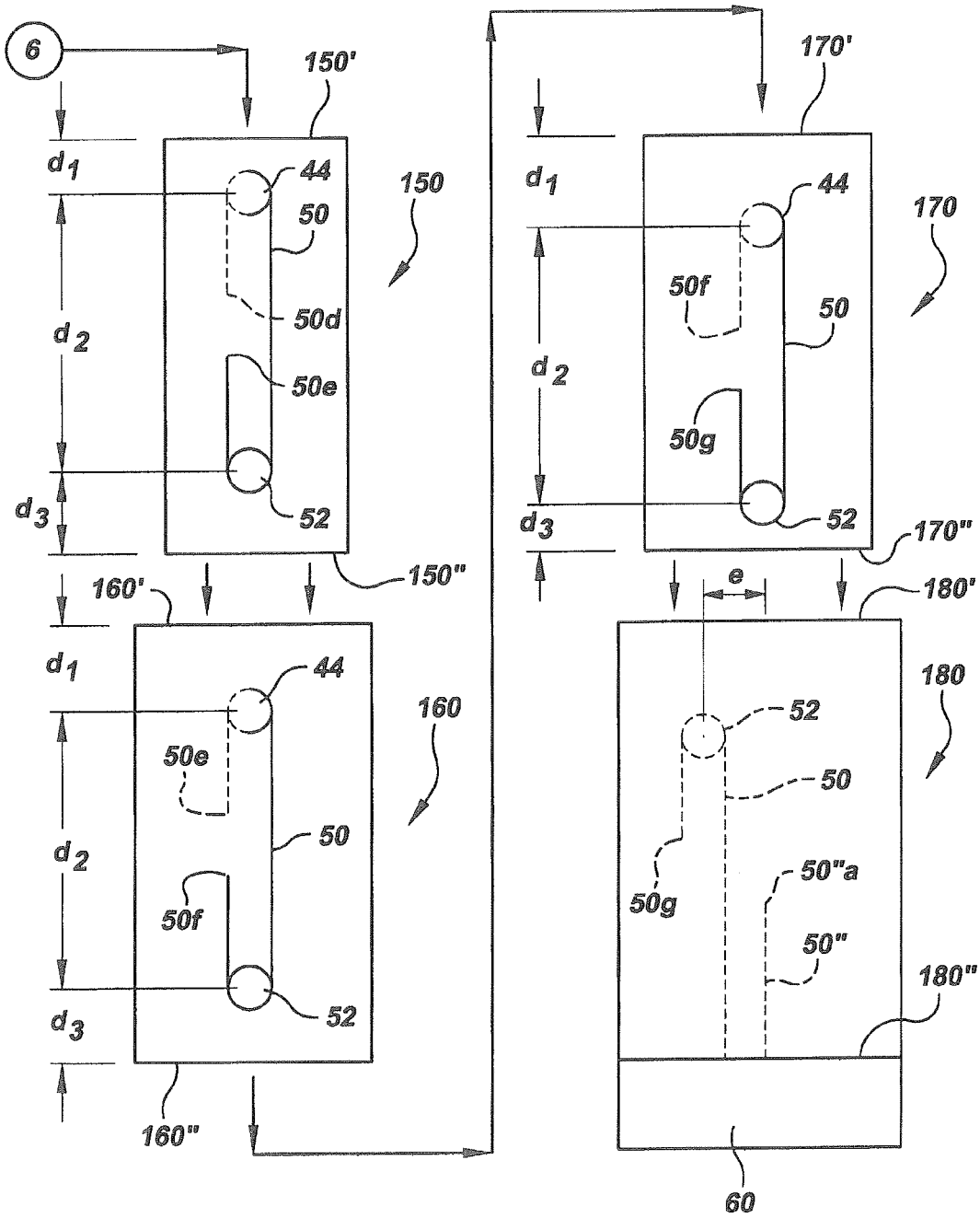
FIG. 7 is a side elevational exploded view of the outer four nested mast sections used to make the preferred telescoping tower system of the present invention.
Figure 8:
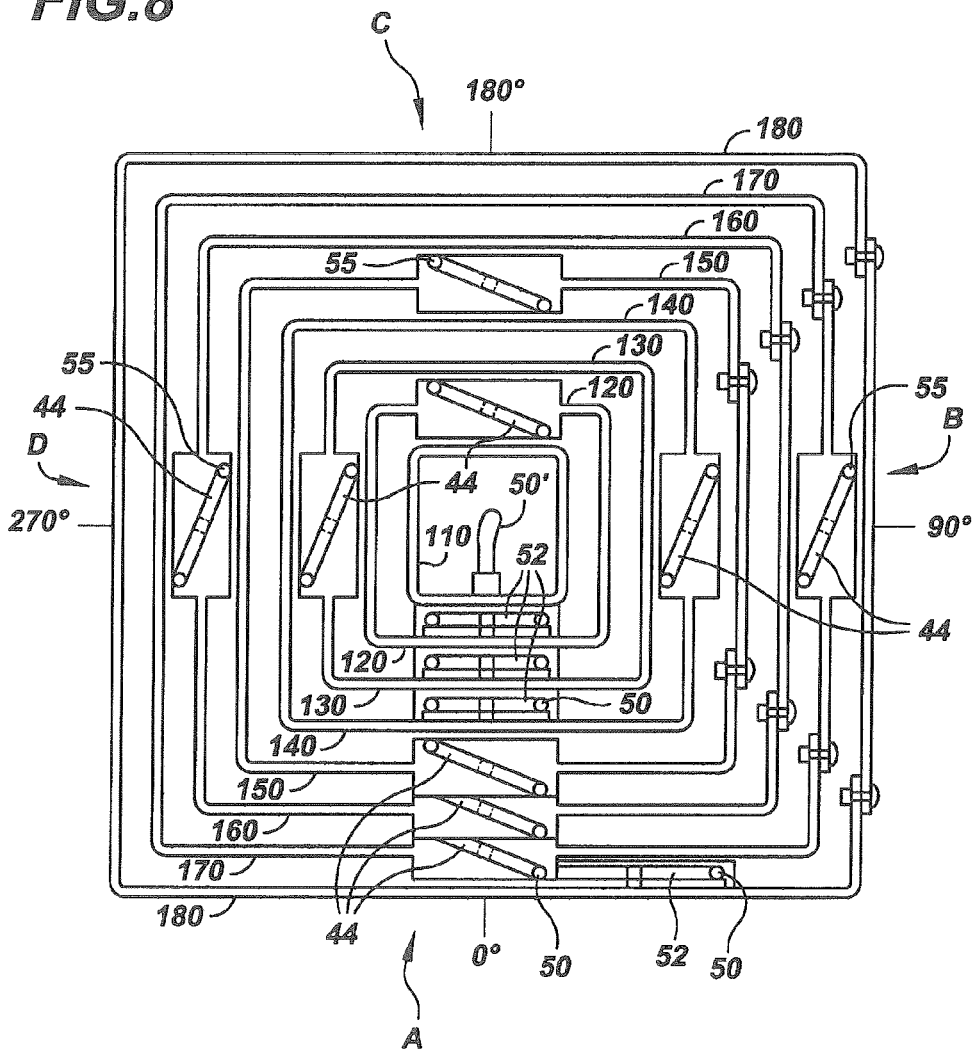
FIG. 8 is a top plan view of the nested mast sections in the preferred telescoping tower system.

Mast section 100 as described above may be constructed in different cross sectional sizes so that the multiple mast sections nest inside one another to create the preferred telescoping tower system of the present invention. One embodiment of the preferred telescoping tower system of the present invention is depicted in FIGS. 6 through 11. FIGS. 6 and 7 show the exploded view of the nested mast sections with the cable power-up and power-down systems to respectively raise and lower the telescoping tower. The individual mast sections are identified as sections 110, 120, 130, 140, 150, 160, 170 and 180, each having a larger cross sectional area than the previous one, so that they may fit inside one another as shown in FIG. 8. Preferably, each mast section is approximately the same length and has a square or other rectangular cross section as described above, although other polygonal cross section configurations may be utilized.

Innermost mast section 110, which forms the topmost section when the telescoping tower system is fully extended, has upper and lower ends 110' and 110", respectively. Power-up cable 50 is secured at a lower end 54 to the outside of one wall of mast section 110, and extends upward. Since in the normally contracted position, preferred mast section 110 is fully received within the interior of mast section 120 so that the ends coincide in position, the cable segments are shown with points identified as a, b, c and so on. These cable points are identified points along the continuous length of the cable and do not identify free or cut ends. When mast section 110 is fully-received within mast section 120, cable point 50*a* continues upward, as shown, within mast section 120, and is turned 180° by flat pulley 52 near end 120' so that cable 50 then extends downward within mast section 120. As used herein, the term flat pulley refers to a pulley that is not necessarily oriented at an acute angle with respect to the mast wall, and is preferably parallel with the mast wall so that the pulley axis is perpendicular to the mast wall. Cable 50 then extends downward and is turned 180° around angled pulley 44 near end 120" so that it is transferred from the inside of mast section 120 to the outside of mast section 120 and upward to cable point 50*b*. As used herein, the term angled pulley refers to a pulley forming an acute angle with the mast section wall, preferably a shallow angle less than 45° as discussed previously. Preferably the angled pulley has the cartridge configuration shown in FIGS. 4 and 5. Since in the contracted position mast section 120 is fully received within mast section 130, the cable from point 50*b* within the interior of mast section 130 continues upward and is turned 180° by flat pulley 52 near end 130' and travels downward, also within mast section 130. After being turned 180° by angled pulley 44 near end 130", cable 50 at point 50*c* is outside of mast section 130.

Again, mast section 130 is fully received within mast section 140, so that the cable from point 50*c* on the inside of mast section 140 continues upward and is turned by flat pulley 52 near end 140' so that it extends downward within the interior of mast section 140. After cable 50 is turned 180° upward by angled pulley 44 near end 140", it emerges on the outside of mast section 140 to cable point 50*d*.

Mast section 140 (FIG. 6) is fully received within mast section 150 (FIG. 7). However, instead of cable 50 being turned 180° by a flat pulley at the upper end of mast section 150, as in the previously discussed mast sections, cable 50 is turned by an angled pulley 44 near end 150' so that it emerges to the outside of mast section 150 and extends downward to flat pulley 52 near end 150", where it remains on the outside of the mast section to cable point 50*e*. Mast section 150 is fully received within mast section 160, so that the cable from point 50*e* on the interior of mast section 160 continues upward and is turned 180° by angled pulley 44 near end 160', where it emerges to the outside of the mast section, and continues downward to flat pulley 52 near end 160", where it is turned 180° upward to cable point 50*f* on the exterior of mast section 160. As before, mast section 160 is fully received within mast section 170, so that the cable from point 50*f* within mast section 170 travels upward and is turned 180° by angled pulley 44 near end 170'. Cable 50 then extends downward along the exterior of mast section 170 to flat pulley 52 near end 170", where it is turned 180° to cable point 50G, remaining on the exterior of mast section 170.

Mast section 170 is fully received within outermost mast section 180, which forms the base of the preferred telescoping tower system of the present invention. Cable 50 continues from cable point 50*g* within mast section 180 upwards where it is turned 180° by flat pulley 52 near end 180' and extends downward, remaining within mast section 180. Cable 50 is then wound by a powered drum assembly within transmission unit 60, discussed further below.

To permit the cable to be properly routed within the nested mast sections, the upper and lower pulleys for the cable power-up system in each mast section are varied in distance from the ends of the mast section on which they are mounted. As shown in the drawings, mast section 120 through 170 show the upper pulley to be a distance $d_1$ from the upper end of the mast section, and the lower pulley to be a distance $d_3$ from the lower end of the mast section. The distance between the upper and lower pulleys in each mast section is shown as distance $d_2$. In each mast section of the preferred embodiment, distance $d_2$ remains a constant. In mast sections 120, 130 and 140, distance $d_1$ increases from one mast section to the next and distance $d_3$ decreases by the same amount. Thus, in mast section 120, the upper pulley 52 is positioned close to mast section end 120' while in mast section 140, upper pulley 52 is a greater distance from mast section end 140'.

In mast section 150, the upper pulley 44 is disposed close to end 150', and the distance $d_1$ again increases in mast 160, and again in mast 170, so that in the latter section the upper pulley 44 is a much larger distance $d_1$ from mast section end 170'. In a manner similar to the inner four mast sections, the lowermost pulley on mast sections 150, 160 and 170 decreases so that in mast section 150, lower pulley 52 is a larger distance from lower section end 150" compared to lower pulley 52 of lower mast end 170". In each of the mast sections 120-170, the pulleys are preferably located along the center line of the wall of the mast section on which they are mounted. In the lower and outermost mast section 180, pulley 52 is offset by a distance e from the center line of the mast section wall for clearance with respect to the pulleys on mast section 170. When the mast sections are nested, shown in FIG. 8, the power-up cable 50 is fully extended to its longest length as it is routed between the various pulleys of the mast sections.

Thus, the intermediate mast sections (i.e., those other than the upper- and lowermost) each have a flat pulley and an angled pulley at opposite ends to guide the power-up cable. Because of the acute angle of angled pulley, the power-up cable may extend directly between the opposite flat and angled pulleys, without intermediate guide or idler pulleys, while remaining close to the mast section wall to permit minimal distance between, and compact packing of, the hollow tube mast sections.

To contract the telescoping tower system after it has been extended, a power-down cable 50' is provided. As shown in FIG. 6, one end of down cable 50' is secured at end 53 within the inside of mast section 110. Down cable 50' extends from point 50'*a*, within all of the nested mast sections, and extends out lower mast section end 180" to the drum in transmission 60. Both the power-up and power-down cables are wound onto the same drum 62 (FIG. 9).

FIG. 8 shows the nested mast sections of the telescoping tower system in the contracted position, where all the mast sections are received within one another. To identify the side walls of each mast section, side A is indicated as being the side of each mast section shown horizontally and in the lower portion of the drawing figure, in the designated 0° position. Side B (also designated the 90° position) of each mast section comprises the vertical section shown to the right in the figure. Side C (designated the 180° position) comprises the horizontal section shown in the upper portion of the figure. Side D (designated the 270° position) comprises as the vertical section on the left side of the figure.

The cable 50 power-up pulleys are preferably all on the same common side, A. As shown in FIG. 8, mast sections 120, 130 and 140 have flat pulleys 52 positioned near the upper end on the inside of each mast section. Mast sections 150, 160 and 170 have angled pulleys 44 disposed near the upper end of each mast section. Mast section 180 has flat pulley 52 positioned on the inside of A. The power down cable 50' extends from the inside of mast section 110 down to the base pulleys.

Figure 9:
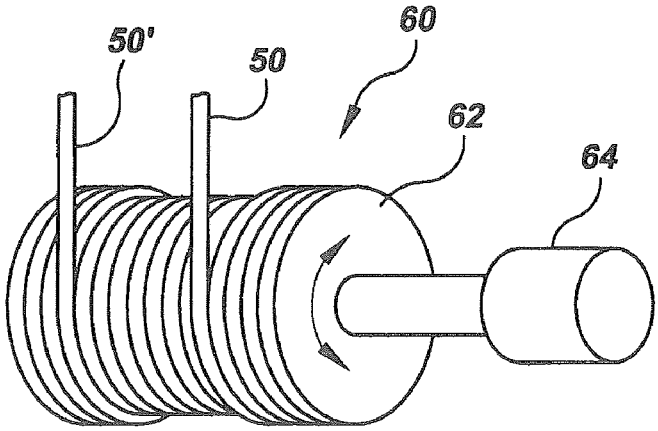
FIG. 9 is a perspective view of the preferred powered cable drum used in the telescoping tower system of the present invention.
Figure 10:
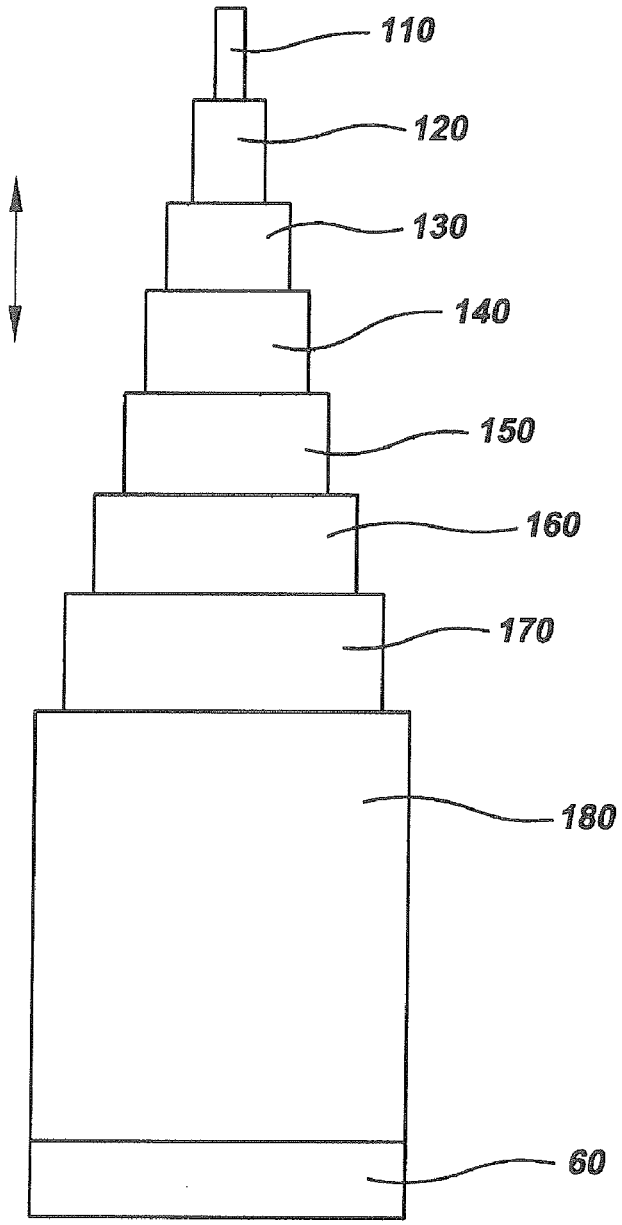
FIG. 10 is a side elevational view of the preferred telescoping tower system of the present invention in a partially extended position.

The preferred cable transmission 60 is depicted in FIG. 9. Cable drum 62 powered by motor 64 simultaneously winds power-up cable 50 onto the drum and unwinds power-down cable 50' from the drum as the drum rotates in one direction cause uppermost mast section 110 to move away from the base, and extend and raise the tower system, as shown in FIG. 10. When the motor rotates the drum in the opposite direction, power-up cable 50 is unwound and power-down cable 50' is wound onto the drum, to pull uppermost mast section 110, and consequently all intervening mast sections, downward and lower the tower system. In the fully retracted and lowered position, all mast sections would fit within base mast section 180.

Figure 11:
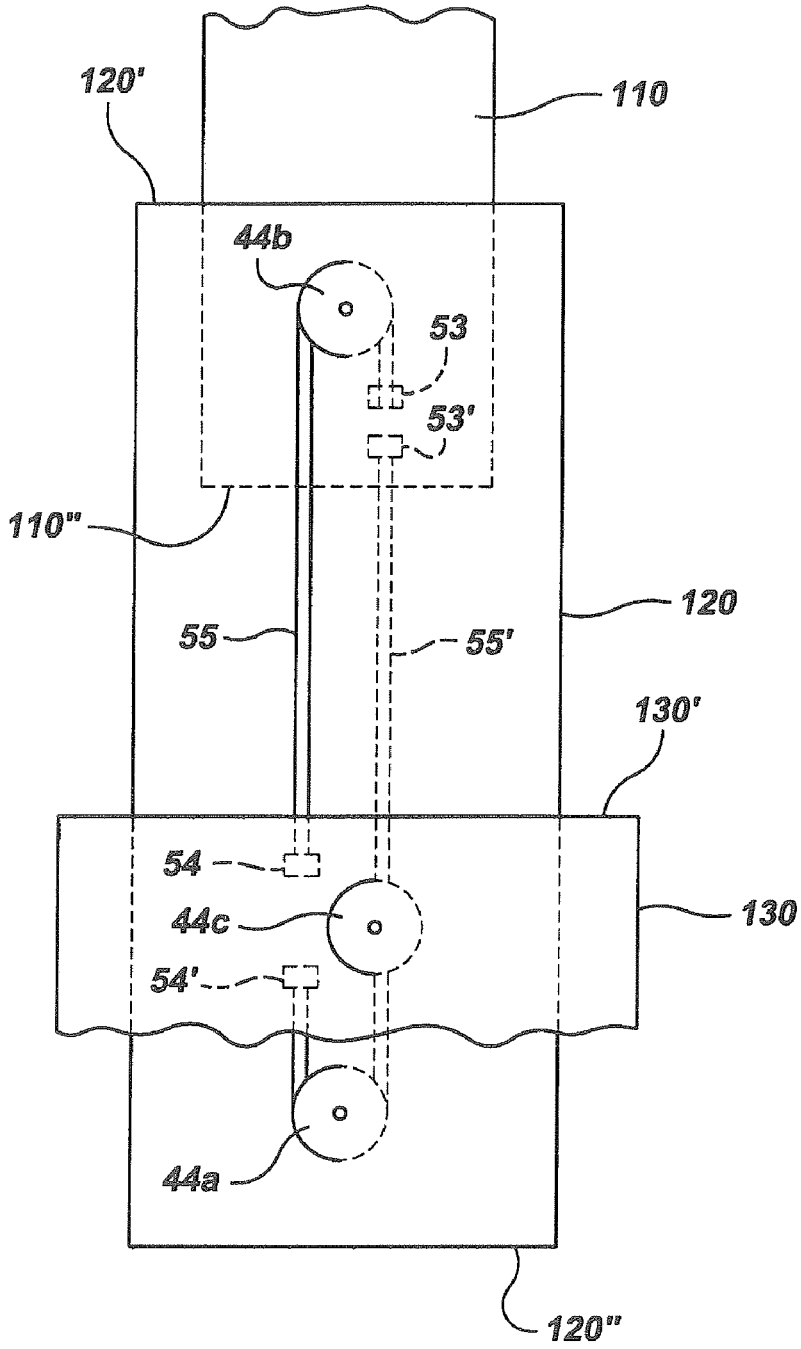
FIG. 11 is a side elevational view of the synchronizing cables used amongst three mast sections of the preferred telescoping tower system of the present invention.

While the cable power-up and power-down systems described herein would be sufficient to raise and lower the mast sections of the telescoping tower system, preferably such mast sections are each raised simultaneously to the same degree with respect to one another as the tower is extended, and likewise are each lowered simultaneously to the same degree with respect to one another as the tower is collapsed. To accomplish such synchronized movement, there are provided synchronizing cables arranged between groups of three adjacent mast sections. As shown in FIG. 11, showing adjacent mast sections 110, 120 and 130, synchronizing cables 55 and 55' are secured at one of their respective ends 53, 53', to points near the lower end 110" of the exterior of mast section 110, and at their respective opposite ends 54, 54', to points near the upper end 130' of the interior of mast section 130. Cable 55 extends upward from the lower end of mast section 110 through angled pulley 44*b* mounted near the upper end 120' of mast section 120 where it is turned 180° and emerges on the outside of mast section 120 to be secured near the upper end 130' of mast section 130. The other synchronizing cable 55' extends downward from mast section 110 along the inside of mast section 120 where it is turned 180° by angled pulley 44*a* near lower end 120" and emerges on the outside of mast section 120 to be secured near the upper end of mast section 130. Each synchronizing cable section 55 and 55' is preferably the same length. In operation, as mast 110 is raised in relation to mast section 120 by the power-up cable system, cable 55' would impart force to likewise raise mast section 120 with respect to mast section 130. Likewise, if mast section 110 were lowered with respect to mast section 120 by the power-down cable system, the other synchronizing cable 55 would impart a force to lower mast section 120 with respect to mast section 130.

The synchronizing arrangement shown among mast sections 110, 120 and 130 uses two cables whose ends are attached to the first and last mast section of the group of three, and which are routed around angled pulleys attached near the upper and lower ends of the center mast section of the three, respectively. This synchronizing arrangement is duplicated for every group of three mast sections used in the preferred telescoping tower system of the present invention. In order to permit close nesting of the mast sections and avoid interference between one synchronizing cable system and another, the cables and pulleys for each group of three synchronizing mast sections are moved to walls on different relative sides of the mast sections. As shown in FIG. 8, the angled pulleys 44 in the group of mast sections 110, 120 and 130 are located on side C (180°) of mast section 120. For the next group of three mast sections, 120, 130 and 140, the angled pulleys 44 are located on mast section 130 on side D (270°), with the ends of synchronizing cables 55 and 55' located at the lower end of mast section 120, and the upper end of mast section 140. The next group of three mast sections, mast sections 130, 140 and 150, have angled pulleys 44 located on side B (90°) of mast section 140, with the synchronizing cables 50, 55' secured at the lower end of mast section 130 and the upper end of mast section 150. The next group of three mast sections, 140, 150 and 160, have angled pulleys 44 located on side C of mast section 150, with the synchronizing cable ends secured to the lower end of mast section 140 and the upper end of mast section 160. In the next group of three mast sections, 150, 160 and 170, the angled pulleys are located on mast section 160 on the D side (270°) with the cable ends located at the lower end of mast section 150 and the upper end of mast section 170. The last group of three mast sections, 160, 170 and 180, have the angled pulleys 44 located on the B side (90°) of mast section 170, with the cable end secured to the lower end of mast section 160 and the upper end of mast section 180.

Thus, as the cable power-up pulley system, which is located on side A (0°) of the mast sections, retracts cable 50 to impart upward force ultimately to mast section 110, the synchronizing cable systems in each group of three mast sections causes each mast section to move simultaneously in an upward direction with respect to the base and with respect to each adjacent larger mast section. Similarly, when the cable down system imparts a downward force to mast section 110, the synchronizing cable systems among each group of three adjacent mast sections causes simultaneously downward movement of each mast section with respect to the base and with respect to its adjacent larger mast section.

As with the power-up cable pulley system, the acute angles of the pulleys in the synchronizing cable system permits the synchronizing cable to extend directly between the opposite angled pulleys, without intermediate guide or idler pulleys, while remaining close to the mast section wall to allow compact packing of the mast sections.

Thus, the present invention provides a method of manufacturing the mast sections in a telescoping tower with high dimensional accuracy at lower manufacturing costs as compared to conventional extruded mast sections. The present invention also provides an improved pulley system in a telescoping tower that simplifies cable guiding between mast sections, and permits close nesting of mast sections. The telescoping tower system of the present invention may fit into a compact space in its retracted position, for example, in the storage compartment of a vehicle. Once at a desired location, the telescoping tower may be used to raise and elevate any desired object, such as a camera, to an elevated height, such as for surveillance.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of manufacturing a tube having a polygonal cross-section with at least one side wall opening therein comprising:

providing a sheet of metal having a length and a width;

providing male and female press brake tools for forming corners in the tube, the press brake tools having a width conforming to the length of the metal sheet, the male press brake tool having an offset axis along which forming force may be applied to the metal sheet to form the tube corners;

forming at least one opening in the metal sheet conforming to the at least one tube side wall opening;

after forming the at least one opening in the metal sheet, aligning the press brake tools along the length of the metal sheet at a first width location and forming a first corner of the tube;

aligning the press brake tools along the length of the metal sheet at a second width location and forming a second corner of the tube;

aligning the press brake tools along the length of the metal sheet at a third width location and forming a third corner of the tube; and aligning the press brake tools along the length of the metal sheet at a fourth width location and forming a fourth corner of the tube, wherein the width locations closest to edges along the width of the metal sheet are less than the dimension of the tube between the corners formed at such width locations such that, after forming of the last corner, an opening remains along the length of the tube between the corners formed at such width locations, and wherein the press brake male tool axis is offset sufficiently to permit the tool to apply forming force to the last corner of the tube through the opening remaining along the length of the tube.

2. The method of claim 1 wherein the press brake male tool is sized sufficiently to permit the tool to be removed through the opening remaining along the length of the tube after applying forming force to the last corner of the tube.

3. The method of claim 1 wherein the width locations closest to edges along the width of the metal sheet are located at a distance from the closest edge which is less than one half the dimension of the tube between the corners formed at such width locations.

4. The method of claim 1 wherein the at least one opening in the metal sheet is formed by mechanical punching.

5. The method of claim 1 wherein the at least one opening in the metal sheet is formed by laser cutting.

6. The method of claim 1 further including closing the opening along the length of the tube with a second metal sheet.

7. The method of claim 1 wherein the tube has a rectangular cross-section.

* * * * *